United States Patent [19]

Julich

[11] 4,441,528

[45] Apr. 10, 1984

[54] CLUTCH ARRANGEMENT FOR CONTROLLING THE HEDDLES OF A WEAVING MACHINE

[75] Inventor: Werner Julich, Wallisellen, Switzerland

[73] Assignee: Sulzer Brothers Limited, Winterthur, Switzerland

[21] Appl. No.: 450,438

[22] Filed: Dec. 16, 1982

[30] Foreign Application Priority Data

Dec. 28, 1981 [EPO] European Pat. Off..81810517.3

[51] Int. Cl.[3] ..... D03C 1/00; D03D 51/46

[52] U.S. Cl. ..... 139/66 R; 139/76; 139/337

[58] Field of Search ..... 36/76, 66 R–74, 36/337

[56] References Cited

U.S. PATENT DOCUMENTS

| | | | |
|---|---|---|---|
| 3,568,725 | 3/1971 | Hindle et al. | 139/76 |
| 3,998,250 | 12/1976 | Townsend | 139/337 X |
| 4,387,741 | 6/1983 | Palau et al. | 139/66 R |

FOREIGN PATENT DOCUMENTS

| | | | |
|---|---|---|---|
| 49707 | 4/1982 | European Pat. Off. | 139/76 |
| 2741199 | 2/1979 | Fed. Rep. of Germany | 139/76 |

*Primary Examiner*—James Kee Chi

*Attorney, Agent, or Firm*—Kenyon & Kenyon

[57] ABSTRACT

The clutch arrangement includes a proximity switch which monitors the coupled or uncoupled position of the pawl with the shaft through a transmission linkage as well as the movement of the heddle. Corresponding control signals are emitted to an electronic control device for comparison of the weaving machine with the weave program. In case of faults, the weaving machine can be immediately stopped. The transmission linkage includes levers which are actuated by the control levers for coupling and uncoupling the pawl with and from the shaft. In addition, the strap about the eccentric includes an abutment surface for actuating the transmission linkage to cause the proximity switch to be switched to an on position.

16 Claims, 2 Drawing Figures

CLUTCH ARRANGEMENT FOR CONTROLLING THE HEDDLES OF A WEAVING MACHINE

Figure 1:
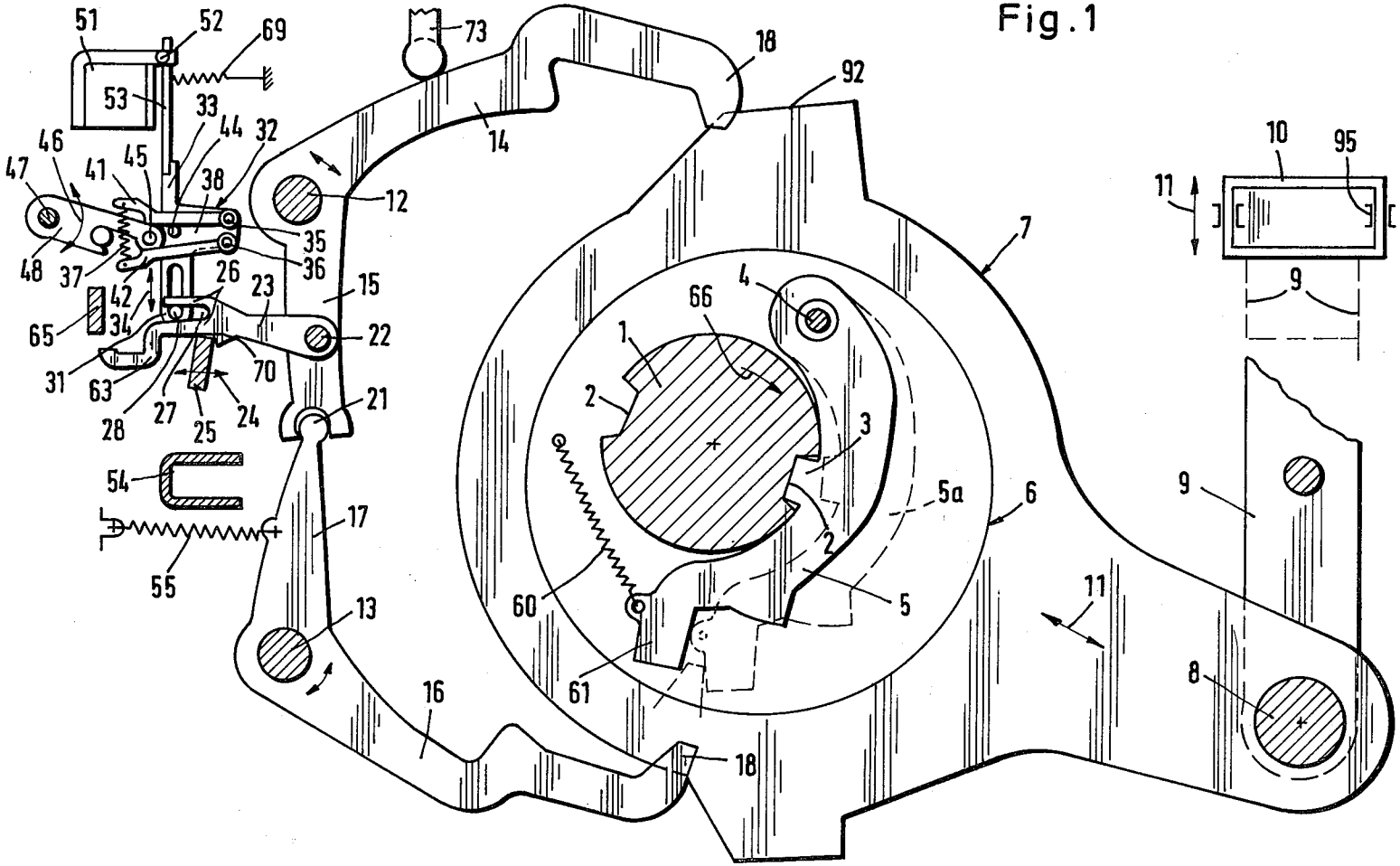

This invention relates to a clutch arrangement for controlling the heddles of a weaving machine.

As is known, various types of arrangements have been used for controlling the operation of the heddles of a weaving machine such as a power loom. For example, as described in German A.S. 27 41 199, one known clutch arrangement utilizes an intermittently rotatable drive shaft having a slot, a pawl which can be engaged in the slot and which is disposed on an eccentric rotatably mounted on the drive shaft as well as a strap for a crank rod of a heddle drive which is disposed about the eccentric. In addition, at least one control lever is movable into the path of the pawl so as to disengage the pawl from the drive shaft. This control lever can be pivoted back and forth by means of a bar which is engagable in a stroke meter drive. In this known arrangement, the bar is spring loaded and is driven by a drive rod against the action of the spring. In this case, the bar is moved back under the action of the spring. This reciprocating movement may or may not be coupled with a stroke meter depending on whether or not the bar is released by an armature of an associated electro-magnet.

However, this known clutch arrangement is relatively complicated and requires several springs. Further, the drive parts strike in an unsprung manner against the bar to be coupled with the stroke meter or to be blocked by the armature.

Other clutch arrangements have also been known, such as described in U.S. Ser. No. 300,663 filed Sept. 9, 1981, which use an electronic means for controlling the clutch arrangement and an electronically stored weave program for weaving. However, the operation of the heddles has been supervised merely by a weaving machine operator. Hence, if the weaving machine is stopped due to a disturbance, e.g. a weft thread rupture, a difficulty may arise due to the fact that the weaving machine must be switched back by at least one cycle before the disturbed weft insertion can be repeated. Because of the special nature of the clutch arrangement, the heddles and the electronic control device on being switched back, do not automatically return to the position they occupied before the disturbance. Instead, the heddles and the electronic control device must be switched back singly by the operator and their position must be matched in accordance with the weave program before the weft insertion can be repeated. This is relatively complicated and demands special technical skill of the operator.

Accordingly, it is an object of the invention to provide a clutch arrangement for automatically monitoring the position of a heddle in a weaving machine.

It is another object of the invention to provide a relatively simple monitoring system for monitoring the position of heddles in a weaving machine.

Briefly, the invention provides a clutch arrangement for controlling a heddle of a weaving machine in an automatic manner. The arrangement comprises an intermittently rotatably drive shaft having at least one slot, an eccentric which is rotatably mounted on the shaft and a pawl which is mounted on the eccentric for engagement in the slot of the shaft. In addition, a first means is connected with the eccentric for moving the heddle between a low shed position and a high shed position while a second means selectively couples and uncouples the pawl with and from the shaft. Further, a means for automatically monitoring the position of the heddle is provided.

The means for automatically monitoring the position of the heddle includes at least one control sensor which is operatively connected with the means which is connected with the eccentric in order to emit a signal in response to movement of the heddle to at least one of the shed positions. In addition, the sensor is operatively connected with the means for coupling and uncoupling the pawl in order to emit a signal in response to coupling of the pawl with the shaft.

In one embodiment, the means which connects the eccentric with the heddle includes a strap concentrically mounted about the eccentric and a rod connected between the strap and heddle. In addition, the means for coupling and uncoupling the pawl includes a pivotally mounted control lever for movement into and out of the path of movement of the pawl. In this embodiment, the sensor is in the form of an inductive proximity switch and the monitoring means includes a transmission linkage between the control lever and the switch. This transmission linkage serves to move the switch to an off position in response to the control lever actuating the transmission linkage with the pawl engaged in the shaft. In addition, the strap includes an abutment surface for actuating the transmission linkage in order to move the proximity switch to an on position.

A ratchet means is also provided for holding the transmission linkage in one of two discrete positions corresponding to the off and on positions of the proximity switch.

The automatic monitoring of the operation of each heddle with a clutch arrangement of the above nature permits the heddles to be checked during weaving. In particular, the clutch arrangement permits the respective position, i.e. high, low or middle shed position, of a heddle to be monitored and, possibly, the direction of movement of the heddles for comparison with a weave program in an automatic manner. If there is a deviation from the program, the weaving machine can be stopped before a faulty weft is inserted.

In the event there is a weft breakage with a resulting stoppage of the weaving machine, the machine can be advanced by a so-called pick-finding device and the heddles brought back to a position which existed before the weft insertion disturbance by an electronic control via the monitoring means. The weft insertin can then be repeated.

Figure 2:
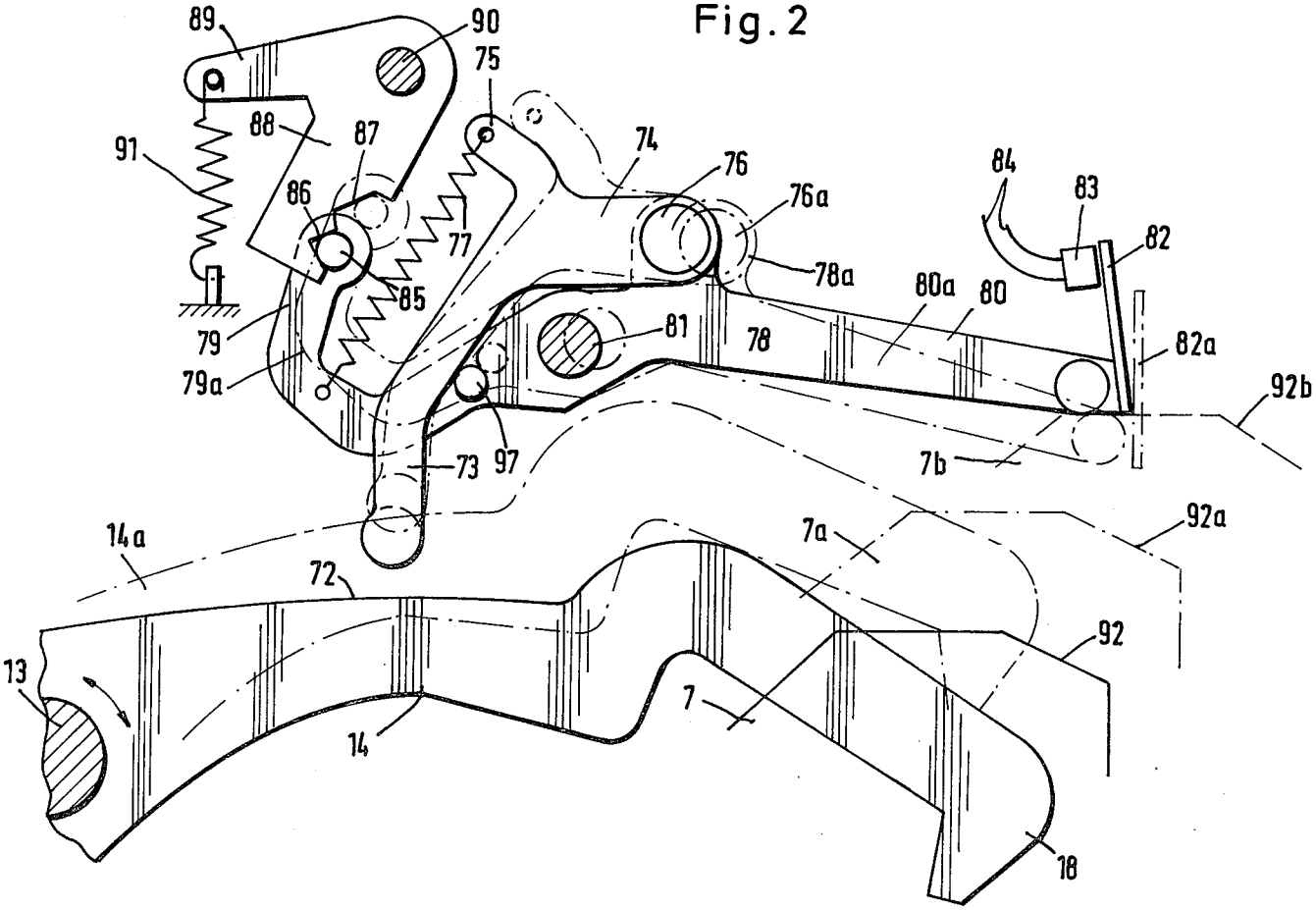

These and other objects of the invention will become more apparent from the following detailed description taken in conjunction with the accompanying drawings wherein:

FIG. 1 illustrates a sectional view of a clutch arrangement according to the invention; and FIG. 2 illustrates an enlarged view of an automatic monitoring means in accordance with the invention.

Referring to FIG. 1, the clutch arrangement is used for controlling a heddle (not shown) of a weaving machine. As indicated, the clutch arrangement incorporates a drive shaft 1 which is intermittently rotatable in the direction indicated by the arrow 66 in increments of 180° off a main shaft (not shown) of the weaving machine. The drive shaft 1 includes a pair of diametrically opposed slots 2 for selectively receiving a nose 3 of a pawl 5 which is pivotally mounted by a suitable pivot 4 on an eccentric 6. The eccentric 6 is, in turn, rotatably mounted on the drive shaft 1 for purposes as described below. As shown, an extension spring 60 is secured to a free end of the pawl 5 and to the eccentric 6 so as to bias the pawl 5 towards the drive shaft 1.

In addition, a means is connected with the eccentric 6 for moving a heddle 10 between a low shed position and a high shed position. This means includes a strap 7 which is disposed about the eccentric 6 and articulated at a pivot point 8 to a rod 9 so as to transfer a reciprocating movement of the strap 7 which occurs in the direction indicated by the arrow 11 to the associated heddle 10 of the loom.

Of note, the drive shaft 1 mounts a plurality, for example six to twelve, of the drive parts 6, 7 for each heddle of the machine. Thus, the drive shaft 1, eccentrics 6 and straps 7 form the so-called eccentric machine for the drive and control of all heddles of the machine. The heddles are thus movable according to a weaving program for the warp threads in a high or low shed position.

A means is also provided for selectively coupling and uncoupling the pawl 5 with and from the shaft 1. This means includes a pair of two-armed control levers 14, 15; 16, 17 which are pivotally mounted on fixed bearing pins 12, 13. As shown, each lever has a hook 18 at the free end which can be moved into the path of the pawl 5. In addition, the two control levers are connected via the arms 15, 17 in an articulated joint 21.

The clutch arrangement also has a bar 23 which is pivotally connected via a pin 22 to the arm 15 of one lever for moving the control levers between a blocking position and a release position (as shown). This bar 23 is, in turn, movable between an operative position as shown in FIG. 1 to cooperate with a stroke meter drive 25 and an inoperative position out of the influence of the stroke meter drive 25. As indicated in FIG. 1, the stroke meter drive 25 is movable in a back and forth direction as indicated by the arrow 24.

The bar 23 has a forked portion 26 forming a slot 27 as well as a bend 63 and a shoulder 70 for abutting the stroke meter drive 25.

A three-armed stroke member is mounted in a suitable manner so as to be moved up and down as indicated by the arrow 34. One arm 31 of this stroke member is slotted and engages a pin 28 which, in turn, fits into the slot 27 of the bar 23. A second arm 32 carries a pair of levers 41, 42 (overload levers). These levers 41, 42 are pivotally mounted via pivots 35, 36 at one end and are biased towards each other by a spring 37. The levers 41, 42 and spring 37 form a so-called centerpoint spring support. In addition, the levers 41, 42 form a slot 38 within which a pin 44 mounted on the stroke member is disposed. The third arm 33 acts as a scanning arm for purposes as described below. In this manner, the spring 37 is interposed between the stroke member and the bar 23 for transmitting forces therebetween.

As shown in FIG. 1, a drive lever 48 is pivotally mounted about a fixed pin 47 to pivot in the direction indicated by the arrow 46 in order to impart motion of the stroke member 31, 32, 33. This drive lever 48 carries a pin 45 which extends into the slot 38 between the levers 41, 42. During operation, the drive lever 48 executes a complete up and down stroke while the drive shaft 1 rotates only by 180° (double stroke method).

A program control device for controlling the operation of the pawl 5 is disposed above the scanning arm 33 of the stroke member. As indicated, the program control device is formed by a fixed electro-magnet 51 and an armature 53 which is pivotable about a pivot 52. The electromagnet 51 functions to attract the armature 52 thereto against the biasing force of a spring 69. As indicated, the spring 69 is fixed to a fixed point within the machine and to the armature 53 to pivot the armature 53 away from the electro-magnet 51.

A fixed stop 54 is provided to limit the swinging movement of the control levers 14, 15; 16, 17. As indicated the stop 54 is disposed in the path of the arm 17 and an extension spring 55 is secured to the arm 17 and to a fixed point in the machine to bias the arm 17 against the stop 54. A stop 65 is also mounted in a suitable member to limit the upward movement of the bar 23 by abutting against a nose of the bar 23.

Referring to FIG. 2, a means is also provided for automatically monitoring the position of the heddle 10. This means includes a transmission linkage which is composed of two three-armed levers 73, 74, 75; 78, 79, 80. One lever arm has an arm 73 which is disposed to cooperate with an abutment surface 72 on the control lever 14 while being pivotally mounted via a pin 76 on one arm 79 of the other three-armed lever 78, 79, 80. In addition, a spring 77 is secured between the arms 75 and 79 in order to bias the three-armed lever 73–75 counter clockwise, as viewed, about the pin 76. The three-armed lever 78–80 is pivotally mounted on a fixed pin 81 and carries a stop 97 against which the arm 73 of the lever 73–75 abuts. Of note, the spring 77 serves to bias the three-armed lever 78–80 in a clockwise manner as viewed. The arm 80 also carries a vane 82 which is disposed to cooperate with a sensor in the form of an inductive proximity switch 83. This switch 83 is connected via connecting wires 84 to an electronic control device from which the weave program, and hence, the movement of the heddles 10 of the weaving machine is controlled. The switch cooperates with the vane 82 so as to be either in an on position as shown in solid line in FIG. 2 or an off position as indicated in dotted line in FIG. 2.

The clutch arrangement also includes a ratchet means for holding the transmission linkage in one of the two discrete positions corresponding to the on and off position of the proximity switch 83. To this end, the ratchet means includes a two-armed ratchet lever 88, 89 which is pivotally mounted on a pin 90 and biased by a spring 91 in a counter-clockwise manner, as viewed. One arm 88 of the lever has a pair of ratchets 86, 87 formed therein while the other arm 89 is secured to one end of the spring 91. The ratchet means also includes a roller 85 which is carried on an arm 79 of the lever 78–80 for cooperation with one or the other ratchet 86, 87.

Referring to FIGS. 1 and 2, the strap 7 carries an abutment surface 92 against which an arm 80 (see FIG. 2) of the lever 78–80 is able to cooperate.

The operation of the monitoring means is as follows:

Referring to FIG. 1, the drive shaft 1 is in a stand-still position in which the pawl 5 can, if the weaving program requires, be coupled. That is, the shaft 1 and pawl 5 are in a position so that the pawl 5 may either be coupled to the shaft 1 as indicated in solid line or disengaged from the shaft as indicated in dotted line. In this position, it is assumed that the heddle 10 is in a low shed position. Further, it is assumed that upon further rotation of the shaft 1 in the direction indicated by the arrow 66, i.e. clockwise, as viewed, the electro-magnet 51 does not receive current. Hence, with the following sensing operation, the armature 53 blocks the upward movement of the scanning arm 33. As a result, the bar 23 remains in the zone of cooperation of the stroke meter 25.

When the stroke meter 25 reaches the extreme right hand position illustrated in FIG. 1, the control levers 14, 15; 16, 17 are pivoted into the inoperative position shown in FIG. 1. This position corresponds to the position 14*a* of FIG. 2.

Upon upward movement of the control arm 14 into the inoperative position 14*a*, the abutment surface 72 abuts against the lever arm 73 so that the three-armed lever 73–75 pivots clockwise against the tension of the spring 77 into the dash-dot position indicated in FIG. 2. In so doing, the bearing pin 76 is moved into the dotted line position 76*a*. At the same time, the three-armed switching lever 78–80 is pivoted about the fixed pin 81 in a clockwise manner, as viewed, into the dotted line position so as to place the switch 83 in an off position.

With this rotation, the roller 85 on the arm 79 snaps from the lower ratchet 86 into the upper ratchet 87 while the lever 88, 89 temporarily pivots clockwise.

With the switch 83 in the off position, a signal is emitted via the lines 84 to the electronic control device (not shown) to indicate that during the following standstill position of the shaft 1, the heddle 10 is in the high shed position. The signal also indicates that the heddle 10 remains coupled, i.e. that the pawl 5 is coupled with the shaft 1, and that upon further rotation of the shaft 1, the heddle 10 will again pass into the low shed position.

In the high shed position of the heddle 10, the shaft 1, eccentric 6 and pawl 5 are pivoted by 180° relative to the position indicated in FIG. 1. During this time, the pawl 5 is engaged. However, the strap 7 moves during the last movement phase of the shaft 1 from its lowest position as shown in solid lines in FIG. 2 into a middle position 7*a* as indicated in dash-dot lines. Thereafter, the shaft 1 executes a further half revolution so that the abutment surface 92 on the strap 7 moves from the central position 92*a* to the upper position 92*b* as indicated in broken lines in FIG. 2. Thus, the arm 80 of the switching lever 78–80 is engaged by the abutment surface 92 and pivoted upwardly, i.e. counter clockwise about the pin 81. Hence, the switching lever 78–80 is again pivoted into the solid line position indicated in FIG. 2. At this time, the spring 77 is tensioned so that the arm 73 of the lever 73–75 at first bears against the control lever 14.

At the same time, the vane 82 moves into the upper position indicated in solid lines in FIG. 2 so as to again cooperate with the proximity switch 83. The switch 83 is thus in an on position and a signal is emitted to the electronic control device to indicate that the coupled heddle 10 is moving toward the low shed position.

The control lever 14 is then moved back by the stroke meter 25 (see FIG. 1) from the dotted line positions 14*a* of FIG. 2 to the solid line position 14. During this time, the lever arm 73 follows the control lever 14 so that the lever 73–75 is pivoted in counter clockwise fashion, as viewed, about the bearing pin 76 to reach the position shown in solid lines in FIG. 2 abutting against the stop 97.

During this last half-revolution of the shaft 1, the control levers 14, 15; 16, 17 are pivoted inwardly, as viewed in FIG. 1, due to the cooperation of the bar 23 with the stroke meter 25.

If on the basis of the next scan by the scanning arm 33 and armature 53, the conrol levers 14, 15; 16, 17 remain in the inwardly pivoted position, the end 61 of the pawl 5 abuts against the nose 18 of the lever 16, 17. As a result, the pawl 5 is disengaged and moves into the broken line position indicated in FIG. 1. Thus, during the next cycle of the shaft 1, the arm 80 of the switching lever 78–80 and the vane 82 remain in the upper position shown in solid line in FIG. 2. A corresponding signal sent to the electronic control device by the proximity switch 83 then indicates that the heddle 10 is now disengaged and remains disengaged until the control levers 14–17 are again pivoted outwardly via the scanning arm 33 and electro-magnet 53 and the pawl 5 is again engaged.

As indicated above, with the control levers 14–17 pivoted outwardly to the dash-dot position indicated in FIG. 2, the pawl 5 and heddle 10 are connected. Hence, the vane 82 is continuously being moved alternately to and from the proximity switch 83. The resulting signals to the electronic control device indicate the off and on positions of the switch 83. The electronic control device is thus able to compare this sequence of signals with the stored weave program and, if correct, permits the weaving machine to continue to run. However, if the back and forth movement of the heddle 10 does not correspond to the weave program, the machine is stopped.

If, however, the control levers 14–17 are pivoted inwardly on the basis of the scan of the components 33, 53 (the position indicated in solid line by the control lever 14 in FIG. 2), the vane 82 remains in front of the proximity switch 83. The corresponding signal to the electronic control device thus applies the message that the pawl 5 is disengaged and the heddle 10 stopped. Because the pawl 5 is disengaged from the shaft 1, the strap 7 with the abutment surface 92 remains stationary. Hence, the vane 82 remains locked in the on position via the ratchet means 86–89 and can be lowered only when the control lever 14–17 are again pivoted outwardly on the basis of the scan of the components 33, 53, i.e. until the arm 14 moves into the dash-dot line position 14*a*.

If desired, the respective heddle position and the movement direction of the heddle 10 can be sensed at a different point of the heddle drive rather than at the control levers 14–17 and the strap 7. For example, the heddle position and movement may be sensed in a guideway 95 for the heddle 10 which is located on the weaving machine (see FIG. 2). Further, instead of using a proximity switch 83, another type of sensor can be used for scanning the coupling of the pawl 5 and/or the heddle movement. For example, a photo-diode or a mechanical, hydraulic or pneumatic scanning element may be used instead of the switch 83. Further, two scanning sensors 83 may be used for scanning both positions 82, 82*a* of the switch.

The invention thus provides a clutch arrangement wherein the heddles and the respective position of the heddles can be monitored during weaving and compared with a weave program automatically. Hence, should a weft break, the position of the heddles can be determined so as to facilitate a return of the heddles and electronic control device into a matched condition with the weave program before weaving resumes.

What is claimed is:

1. A clutch arrangement for controlling a heddle of a weaving machine, said arrangement comprising an intermittently rotatable drive shaft having at least one slot therein;

an eccentric rotatably mounted on said shaft;

a pawl mounted on said eccentric for engagement in said slot of said shaft;

first means connected with said eccentric for moving the heddle between a low shed position and a high shed position;

second means for selectively coupling and uncoupling said pawl with and from said shaft; and third means for automatically monitoring the position of the heddle.

2. A clutch arrangement as set forth in claim 1 wherein said third means includes at least one control sensor operatively connected with said first means for emitting a signal in response to movement of the heddle to at least one of said shed positions.

3. A clutch arrangement as set forth in claim 2 wherein said sensor is operatively connected with said second means for emitting a signal indicating coupling of said pawl with said shaft.

4. A clutch arrangement as set forth in claim 3 wherein said first means includes a strap concentrically mounted about said eccentric and a rod connected between said strap and the heddle and wherein said second means includes a pivotally mounted control lever for movement into and out of a path of movement of said pawl.

5. A clutch arrangement as set forth in claim 4 wherein said sensor is an inductive proximity switch.

6. A clutch arrangement as set forth in claim 5 wherein said third means further includes a transmission linkage between said control lever and said switch for moving said switch to an off position in response to said control lever actuating said transmission linkage with said pawl engaged in said shaft.

7. A clutch arrangement as set forth in claim 6 wherein said strap includes an abutment surface for actuating said transmission linkage to move said switch to an on position.

8. A clutch arrangement as set forth in claim 7 which further comprises a ratchet means for holding said transmission linkage in one of two discrete positions corresponding to said off position and said on position of said switch.

9. A clutch arrangement for controlling a heddle of a weaving machine, said arrangement comprising an intermittently rotatable drive shaft having at least one slot therein;

an eccentric rotatably mounted on said shaft;

a pawl mounted on said eccentric for engagement in said slot of said shaft;

first means for selectively coupling and uncoupling said pawl with and from said shaft; and second means for automatically monitoring the position of the heddle, said latter means including at least one control sensor operatively connected with said first means for emitting a signal indicating coupling to said pawl with said shaft.

10. A clutch arrangement as set forth in claim 9 wherein said sensor is an inductive proximity switch.

11. A clutch arrangement as set forth in claim 10 wherein said second means further includes a transmission linkage between said control lever and said switch for moving said switch to an off position in response to said control lever actuating said transmission linkage wih said pawl engaged in said shaft.

12. A clutch arrangement as set forth in claim 11 which further comprises a ratchet means for holding said transmission linkage in one of two discrete positions corresponding to said off position and said on position of said switch.

13. A clutch arrangement for controlling a heddle of a weaving machine, said arrangement comprising an intermittently rotatable drive shaft having at least one slot therein;

an eccentric rotatably mounted on said shaft;

a pawl mounted on said eccentric for engagement in said slot of said shaft;

first means connected with said eccentric for moving the heddle between a low shed position and a high shed position; and second means for automatically monitoring the position of the heddle, said second means including at least one control sensor operatively connected with said first means for emitting a signal in response to movement of the heddle to at least one of said shed positions.

14. A clutch arrangement as set forth in claim 13 wherein said sensor is an inductive proximity switch.

15. A clutch arrangement as set forth in claim 14 wherein said first means includes a strap concentrically mounted about said eccentric with an abutment surface thereon and a rod connected between said strap and the heddle and wherein said second means includes a transmission linkage between said abutment surface and said switch for moving said switch to an on position.

16. A clutch arrangement as set forth in claim 15 which further comprises a ratchet means for holding said transmission linkage in one of two discrete positions corresponding to said off position and said on position of said switch.

* * * * *